US007895932B1

(12) United States Patent
Ohnstad

(10) Patent No.: US 7,895,932 B1
(45) Date of Patent: Mar. 1, 2011

(54) OPTICALLY CLEAR TURRET DOME, AND COMBINED TURRET SHROUD

(75) Inventor: Thomas S. Ohnstad, Salem, OR (US)

(73) Assignee: D&O Innovations, LLC, Scappoose, OR (US)

( * ) Notice: Subject to any disclaimer, the term of this patent is extended or adjusted under 35 U.S.C. 154(b) by 532 days.

(21) Appl. No.: 11/975,620

(22) Filed: Oct. 19, 2007

Related U.S. Application Data

(60) Provisional application No. 60/859,117, filed on Nov. 14, 2006.

(51) Int. Cl.
*F41H 5/20* (2006.01)

(52) U.S. Cl. ..... 89/36.13; 89/931; 89/935

(58) Field of Classification Search ..... 89/36.13, 89/40.03, 40.04, 41.02, 36.02, 931, 935
See application file for complete search history.

(56) References Cited

U.S. PATENT DOCUMENTS

| | | | | | |
|---|---|---|---|---|---|
| 1,438,878 | A * | 12/1922 | Tomassette | 89/40.03 |
| 2,358,257 | A * | 9/1944 | Schwab | 89/36.03 |
| 2,445,852 | A * | 7/1948 | Huey et al. | 89/41.02 |
| 2,685,233 | A * | 8/1954 | Rose | 89/37.17 |
| 3,429,222 | A * | 2/1969 | Flannery et al. | 89/41.02 |
| 3,625,563 | A * | 12/1971 | Dickinson et al. | 297/333 |
| 3,954,041 | A * | 5/1976 | Mechulam et al. | 89/36.13 |
| 4,004,494 | A * | 1/1977 | Mechulam et al. | 89/36.14 |
| 4,079,161 | A * | 3/1978 | Kile | 428/220 |
| 5,170,690 | A * | 12/1992 | Smirlock et al. | 89/36.08 |
| 5,333,532 | A * | 8/1994 | Smirlock et al. | 89/36.02 |
| 5,353,680 | A * | 10/1994 | Tiomkin et al. | 89/37.03 |
| H1519 | H * | 3/1996 | Semple | 89/36.02 |
| H1567 | H * | 8/1996 | Parsons et al. | 89/36.02 |
| 5,665,450 | A * | 9/1997 | Day et al. | 428/114 |
| 5,686,689 | A * | 11/1997 | Snedeker et al. | 89/36.02 |
| 6,101,917 | A * | 8/2000 | Klatte et al. | 89/41.01 |
| 6,532,857 | B1 * | 3/2003 | Shih et al. | 89/36.02 |
| 7,030,579 | B1 * | 4/2006 | Schmitz et al. | 318/139 |
| 7,413,247 | B2 * | 8/2008 | Van Druff et al. | 297/339 |
| 7,478,580 | B1 * | 1/2009 | Parimi et al. | 89/36.13 |
| 2005/0188831 | A1 * | 9/2005 | Squires et al. | 89/36.02 |
| 2007/0000377 | A1 * | 1/2007 | Ohnstad | 89/36.13 |

* cited by examiner

*Primary Examiner* — Michael Carone
*Assistant Examiner* — Jonathan C Weber
(74) *Attorney, Agent, or Firm* — Jon M. Dickinson, Esq.; Robert D. Varitz, Esq.

(57) ABSTRACT

A vehicle-top gun turret shroud-dome structure for mounting on a vehicle-top gun turret includes a turret shroud having a generally annular base and an open upper margin; an optically clear dome structure constructed to mate with and seal to the open upper margin; wherein the turret shroud and the dome structure provide, for a gunner enclosed thereby, anti-shock, anti-ballistic and anti-blast shockwave protection.

9 Claims, 2 Drawing Sheets

OPTICALLY CLEAR TURRET DOME, AND COMBINED TURRET SHROUD

RELATED APPLICATION

This Application claims priority from U.S. Patent Provisional Patent Application Ser. No. 60/859,117, for Optically Clear Turret Dome, and Combined Turret Shroud, filed Nov. 14, 2006, the entire contents of which are incorporated herein by reference.

FIELD OF THE INVENTION

This invention pertains to structure for providing anti-ballistic and anti-blast-shock-wave protection for a military gunner who is stationed on the roof of a vehicle, such as a military High Mobility Multi-wheeled Vehicle (HMMWV), also referred to as a Humvee vehicle. In particular, it relates both to a unique, optically clear, dome-shaped overhead spanner structure which seats on the upwardly facing shoulder of a generally annular turret shroud which is disposed around a vehicle-top weapon, and to this dome in combination with the mentioned shroud.

BACKGROUND OF THE INVENTION

In a warfare operating theater one of the weapons which is often deployed is a single gun, such as a large caliber machine gun, disposed on the roof of a military vehicle to be operated by a gunner positioned at least partially on top of the vehicle with that gun. Such a vehicle-top gun is made not only for raising and lowering of its barrel, but also for swiveling 360° about a generally upright axis.

It is obvious that a gunner positioned with this kind of a weapon is highly exposed as an enemy target, and the present invention provides structure which is intended to afford significant anti-ballistic, and also anti-blast-shock-wave, protection to such a gunner.

SUMMARY OF THE INVENTION

A vehicle-top gun turret shroud-dome structure for mounting on a vehicle-top gun turret includes a turret shroud having a generally annular base and an open upper margin; an optically clear dome structure constructed to mate with and seal to the open upper margin; wherein the turret shroud and the dome structure provide, for a gunner enclosed thereby, anti-shock, anti-ballistic and anti-blast shockwave protection.

This summary and objectives of the invention are provided to enable quick comprehension of the nature of the invention. A more thorough understanding of the invention may be obtained by reference to the following detailed description of the preferred embodiment of the invention in connection with the drawings.

DETAILED DESCRIPTION OF THE PREFERRED EMBODIMENTS

Figure 1:
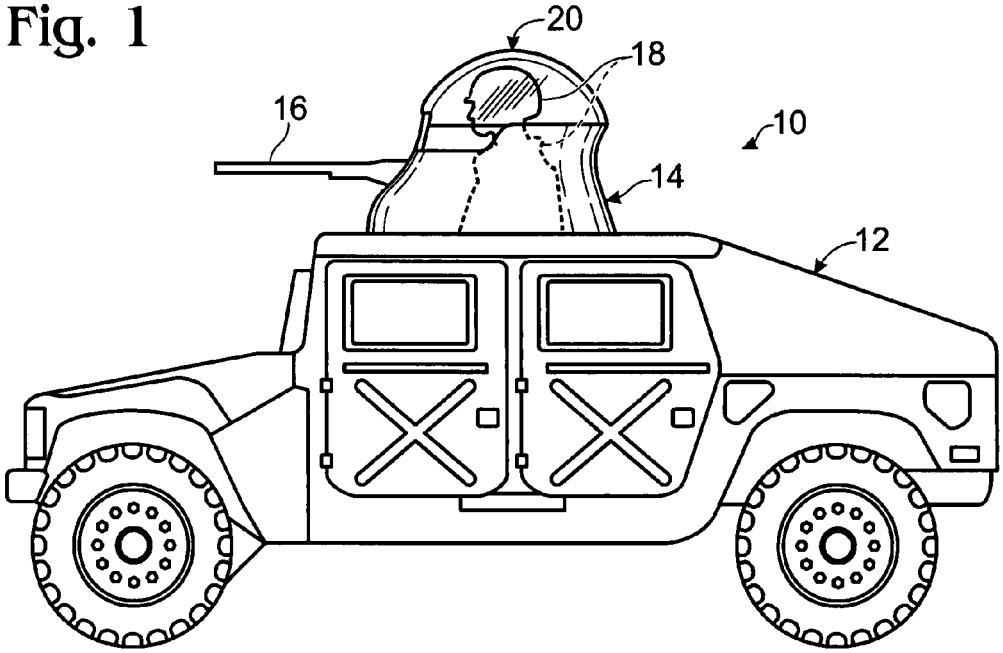
FIG. 1 is a side elevation of a vehicle having a top gun and a turret shroud-dome structure of the invention mounted thereon.
Figure 2:
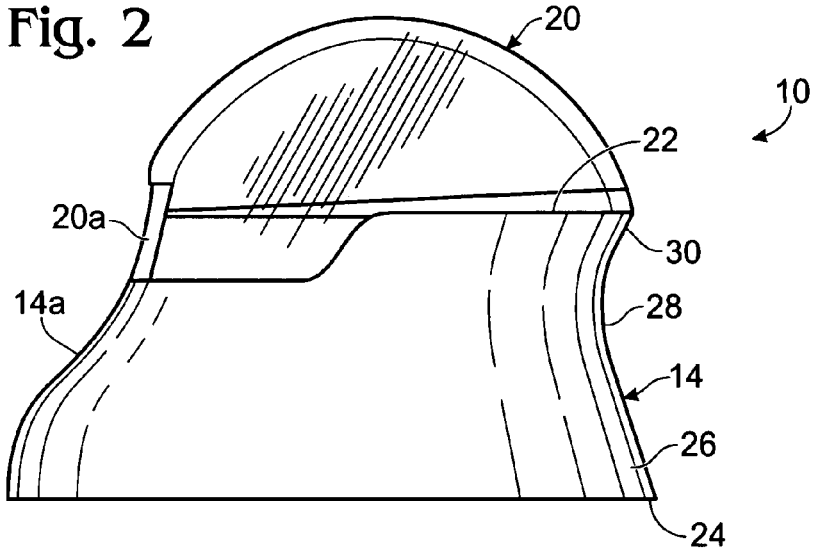
FIG. 2 is a side elevation of the turret shroud-dome structure of the invention.
Figure 3:
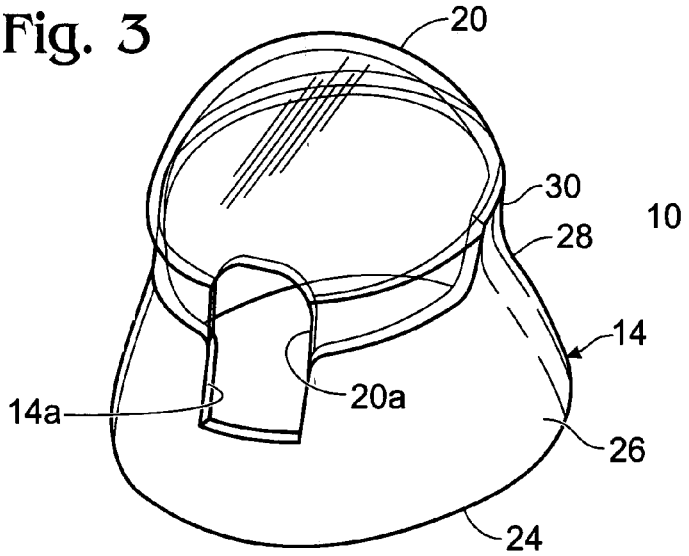
FIG. 3 is a front isometric view of the turret shroud-dome structure of FIG. 2.

The invention includes, and now referring to FIGS. 1-3, a turret shroud-dome structure 10 for mounting on a vehicle 12, such as the military HMMWV, using the existing M-1114 turret mount. The turret shroud-dome structure of the invention includes a generally annular turret shroud 14 which circumsurrounds a roof-top weapon 16 and the operating gunner 18, and an optically clear dome-like spanner structure 20 which seats on top of the generally annular rim, or upwardly facing shoulder, 22, also referred to herein as an open upper margin, of turret shroud 14. Collectively, the shroud and the dome-like cover provide substantial anti-ballistic and anti-blast-shock-wave protection against projectiles and blast shock waves that may be experienced by someone seated within the combined shroud and dome structure. Optical, clarity in the dome affords both high visibility for a rooftop gunner, while at the same time significantly protecting that gunner against the threats just mentioned above.

The turret shroud is designed with the gunner in mind. The turret shroud is flexible, providing a flexible shroud base, in that, an impact with the gunner's shoulder will not cause contusions or broken bones, as may be caused by conventional, rigid metallic shroud systems. The flexibility of the shroud also enhances the ballistic, including blast event, absorption capability because the flexibility of the composite structure absorbs and distributes ballistic energy over a larger area than does a rigid structure. Sitting in the turret has a "feel" of wearing a protective piece of body armor, yet, there is no additional weight which must be carried by the gunner. Advanced lightweight composite materials are used to provide cost effective gun turret Systems which have, among others, the following advantages:

Ballistic and fragmentation protection over a full horizontal 360° and, with the dome structure in place, vertical 180° protection above shoulder 22 of turret shroud 14.

The shroud is, configurable for both .50 cal. and .30 cal. guns. The turret shroud and a gun shield (provided with a .50 cal. gun, not shown) have multi-hit capabilities and provide protection from small arms fire, including 7.62 mm LPS rounds. Ports 14*a* and 20*a* in turret shroud 14 and dome structure 20, respectively, allow projection of gun 16 therethrough.

Turret shroud 14 has a base 24 which connects to the M-1114 turret, or to other similar turret systems on other military vehicles. The lower portion 26 of the turret shroud has an inward slope over approximately two-thirds of its periphery, terminating in a curved portion 28 midway up the height of the turret shroud, which flows into an upper portion 30 having an outward slope, or reverse curve, which has turret shroud shoulder 22 located at its upper margin. The curved shape of the turret shroud provides for off-angle obliquities of incoming rounds, which further enhances the protective qualities of the shroud. A reverse curl located adjacent the top margin of the shroud provides additional protection against ricochets or shrapnel, as from improvised explosive devices (IEDs).

The overall weight of the turret shroud, dome structure and gun shield is less than that of a conventional, metallic turret shroud, and is fabricated to be more balanced than existing turret shroud systems, thus provided enhanced functionality of the turret system. The underlying turret shroud is formed, in the preferred embodiment, of multiple layers of a contour-woven, fibre-reinforced anti-ballistic, anti-shock-wave material woven with a Kevlar®-type material and coated/sealed with a material known as TUFF STUFF, made by Rhino Linings USA, Inc. of San Diego, Calif. The turret shroud structure has, because of the materials from which it is made, a certain degree of flexibility which allows it to yield and flex on impact by a striking projectile for the purpose of dissipating projectile energy.

A modified form of the turret shroud may incorporate ceramic tiles disposed just under the outer surface of the turret shroud to enhance the ballistic capabilities of the turret shroud.

The dome structure of this invention may be either a single-layered structure, or a plural-layer structure, which utilizes, for at least one of its layers, a material known as BATTLEVIEW, which is a multi-component polyurethane formulation, which is optically clear, castable (and thus readily formable), and anti-ballistic. Dome structure 20, also referred to herein as a spanner structure, in the preferred embodiment, is formed of multi layers of material, which may include layers of acrylic or polycarbonate material which sandwich a layer of BATTLEVIEW therein. This multi layer structure may be fabricated using a thermoforming process for the acrylic/polycarbonate and a casting process for the BATTLEVIEW material.

The dome structure herein is preferably mounted on the upper rim portion, or shoulder, of a generally opaque (though not necessarily so) turret shroud for selective opening and closing, and when closed, is suitably firmly anchored in place on top of an underlying turret shroud. A hinge and latch structure (not shown) allows for the dome structure, or closure dome, to be opened or removed when desired.

The clear armor of the dome structure provide excellent vision for the gunner and excellent IED protection from the initial blast and from the resultant shrapnel and debris. The dome structure's geometric configuration provides enhanced protection for the turret shroud, while allowing the gunner to maintain surveillance of the environment about the vehicle. Additionally, the dome structure retains the gunner in the vehicle in the event of a roll-over. A comfort factor is provided by the dome structure, as the heated or cooled air in the vehicle does not readily escape with the dome structure in place, thus providing a somewhat sealed environment within the vehicle. This sealed environment also facilitates communication between the gunner and the vehicle crew because of the geometric shape of the dome itself: the gunner's head is effectively positioned inside a speaker cone.

Figure 4:
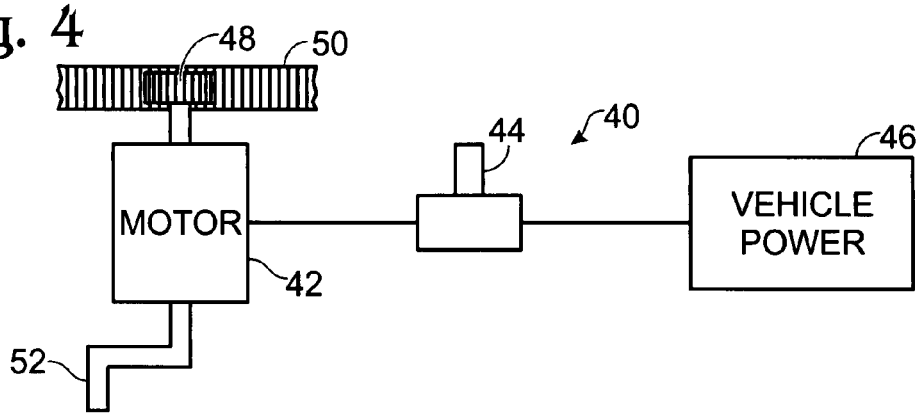
FIG. 4 is a somewhat schematic view of a turret drive mechanism of the invention.

Because of the lighter weight and balanced configuration of the turret shroud and dome structure, the addition of two features is facilitated. The first feature, and now referring to FIG. 4, is the provision of a powered drive 40 for the turret, which augments the hand crank currently used in M-1114 turret systems. Drive 40 includes a motor 42. The turret is rotated by simple movement of the gunner's thumb on a joystick 44, which is mounted near the gun trigger, which activates reversible motor 42, powered by vehicle power 46. A gear 48 on motor 42 engages a gear ring 50, which is part of the M-1114 turret. The turret powered drive is constructed to provide 360° rotation of the turret in less than three seconds, which is considerably faster than manual systems. Motor 42 is equipped with a back EMF function to provide braking for the turret system. The turret motor is provided with a "through crank" 52 so that the turret may still operate using the standard hand crank mechanism in the event of a motor failure or power loss. Because of the reduced weight and balancing of the turret, shroud and dome, the turret may be operated with the vehicle in 20°+ orientations, which is not safely possible with existing systems, which must be locked down in the event of 20°+ operations. The lock down structures are, of course, still provided so that a turret may be locked down during travel.

Figure 5:
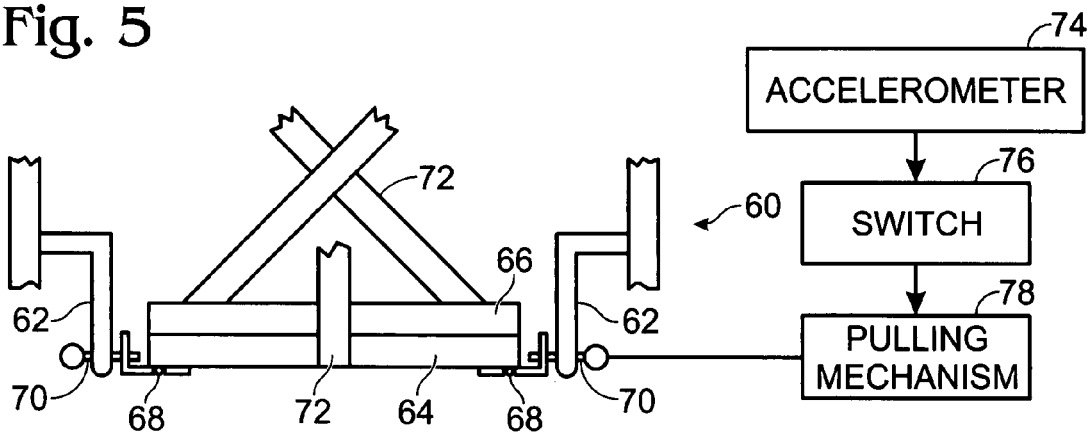
FIG. 5 is a front elevation of a seat structure of the invention.

The second feature, and now referring to FIG. 5, is the provision of a gunner's seat structure 60, which allows the gunner to remain in a comfortable, seated, safe position whilst manning the vehicle gun. Seat structure 60 includes seat supports 62, which are fixed to the M-1114 turret structure, a seat 64 having a seat cushion 66 fixed thereto, seat hinges 68 and seat release pins 70. The seat of the invention is adjustable to the gunner's height and comfort, by adjusting the location of seat 64 by selecting a location in seat supports 62 through which pins 70 are secured. Seat structure 60 actually lowers the gunner's and the vehicle's centers of gravity. The seated position allows the turret shroud and dome structure fully to enclose the gunner. The seat is provided with quick-release pins 70, which are crew accessible, and which allow the crew to "drop" the gunner into the vehicle if required. Shoulder straps 72 are provided to retain the gunner in the event of a roll-over, which straps do not impede the gunner's ability to man the gun.

A variation of the seat structure includes provision of an accelerometer 74, mounted to the vehicle to monitor vehicle orientation, such that, in the event of a blast or roll-over event, the accelerometer trips a switch 76, which activates a pin pulling mechanism 78, which immediately drops seat 64 and draws the gunner into the interior of the vehicle.

Thus, an optically clear turret dome, and combined turret shroud for use on a military vehicle has been disclosed. It will be appreciated that further variations and modifications thereof may be made within the scope of the invention as defined in the appended claims.

I claim:

1. A vehicle-top, gun-turret, shroud-dome structure for mounting over a vehicle-top gun and for enclosing a gunner, the shroud-dome structure, in operable condition relative to a vehicle and its top gun, comprising:

a turret shroud having a generally annular base mounted on and rising above the vehicle and including an open, upper margin which is spaced above the top of the vehicle; and an optically clear dome structure constructed to mate with, seal to, and rise above said open, upper margin;

wherein said turret shroud and said dome structure provide, for a gunner enclosed thereby, anti-shock, anti-ballistic and anti-blast shockwave protection, with said turret shroud, in configuration, having an inwardly sloping lower region terminating in a curved portion which flows into an outwardly sloping portion, said inwardly sloping portion extending downwardly towards a condition of contact with the vehicle top, and said outwardly sloping portion having said open upper margin located at the top thereof, and wherein said curved portion and said outwardly sloping portion extend over about two-thirds of the turret shroud periphery.

2. The shroud-dome structure of claim 1, wherein said optically clear dome structure is fabricated of multiple layers of an optically clear material characterized by providing anti-shock, anti-ballistic and anti-blast shockwave protection.

3. The shroud-dome structure of claim 1, wherein said turret shroud is fabricated of multiple layers of a contour-woven, fibre-reinforced, anti-ballistic, anti-shock-wave material.

4. The shroud-dome structure of claim 1, wherein said dome structure is mounted for selective opening and closing of the top of the underlying turret shroud.

5. The shroud-dome structure of claim 1, wherein said dome structure is either single-layered, or plural-layered, in construction.

6. The shroud-dome structure of claim 1, wherein said turret shroud includes a fiber-reinforced, anti-ballistic, anti-blast-shock-wave, flexible shroud base with an open top, and an anti-ballistic, anti-blast-shock-wave, overhead spanner structure optically clear in nature, and fitted to the open top of the shroud base.

7. The shroud-dome structure of claim 1 which includes a powered drive for the turret, including a motor, and a controller for the turret in the form of a joystick which is mounted near a gun trigger.

8. The shroud-dome structure of claim 1 which includes a gunner's seat structure including seat supports fixed to a turret structure to which the turret is mounted, a seat, seat hinges, and seat quick-release pins, whereby the seat is adjustable by adjusting the location of said seat by selecting a location in seat supports through which said seat release pins are secured, wherein said quick-release pins are crew accessible, allowing the crew to drop the gunner into the vehicle.

9. The shroud-dome structure of claim 8 which further includes a detector for detecting hazardous events, wherein said detector triggers a mechanism to drop the gunner into the interior of the vehicle.

* * * * *